US005448869A

United States Patent [19]

Unruh et al.

[11] Patent Number: 5,448,869

[45] Date of Patent: Sep. 12, 1995

[54] COMPOSITE FRAMING MEMBER AND WINDOW OR DOOR ASSEMBLY INCORPORATING A COMPOSITE FRAMING MEMBER

[75] Inventors: Kirby L. Unruh, Warroad, Minn.; Robert P. Plagemann, Fargo, N. Dak.

[73] Assignee: Marvin Lumber and Cedar Co., Warroad, Minn.

[21] Appl. No.: 198,104

[22] Filed: Feb. 17, 1994

[51] Int. Cl.[6] ..... E04C 2/38

[52] U.S. Cl. ..... 52/656.1; 52/313; 52/734.1; 52/738.1; 49/366; 49/DIG. 2

[58] Field of Search ..... 52/309.7, 656.1, 656.2, 52/656.7, DIG. 8, 727, 313; 49/366, 501, 504, DIG. 2

[56] References Cited

U.S. PATENT DOCUMENTS

| | | | |
|---|---|---|---|
| 3,964,231 | 6/1976 | Buoich et al. | 49/DIG. 2 |
| 4,180,944 | 1/1980 | Stowik et al. | 49/504 |
| 4,374,693 | 2/1983 | Pitt | 156/267 |
| 4,432,179 | 2/1984 | Bachmann | 52/396 |
| 4,492,063 | 1/1985 | Schock et al. | 52/309.7 |
| 4,553,364 | 11/1985 | Legg et al. | 52/309.13 |
| 4,740,405 | 4/1988 | Tanaka et al. | 428/45 |
| 4,862,660 | 9/1989 | Raymond | 52/309.7 X |
| 4,875,321 | 10/1989 | Meyers | 52/DIG. 8 |
| 4,993,204 | 2/1991 | Kurtis et al. | 52/656.2 X |
| 4,995,213 | 2/1991 | Bezubic | 52/656 |
| 5,111,618 | 5/1992 | Kaspar et al. | 49/504 X |

FOREIGN PATENT DOCUMENTS

| | | | |
|---|---|---|---|
| 2404094 | 5/1979 | France | 49/501 |
| 1534770 | 8/1969 | Germany | 49/504 |
| 2642746 | 3/1978 | Germany | 49/366 |

*Primary Examiner*—Carl D. Friedman
*Assistant Examiner*—Creighton Smith
*Attorney, Agent, or Firm*—Nawrocki, Rooney & Sivertson

[57] ABSTRACT

A composite framing member especially suited for use as a stile in a stile and rail door or window assembly. The framing member includes a hollow member, preferably manufactured from a fiberglass reinforced plastic. The hollow member is overlayed with two wood edge inserts and two wood overlays to give the appearance of a solid wood door or window assembly. The edge inserts include surfaces which are coplanar with the longitudinal surfaces of the hollow member, and the overlays are affixed to both the longitudinal surfaces and the coplanar surfaces of the edge inserts to provide added strength at glue lines. The composite framing member further provides a passage within which a locking mechanism may be disposed, yet not visible or accessible, which gives added security.

22 Claims, 2 Drawing Sheets

COMPOSITE FRAMING MEMBER AND WINDOW OR DOOR ASSEMBLY INCORPORATING A COMPOSITE FRAMING MEMBER

TECHNICAL FIELD

The present invention relates to a composite framing member especially suited for use as a stile in window or door assemblies. More narrowly, the composite member of the present invention is directed to a fiberglass-reinforced, pultruded hollow core member containing lineal roving glass fiber and randomly oriented glass fiber matting in a matrix of polyester resin with a generally planar member completely overlying the core member.

BACKGROUND OF THE INVENTION

Window or door assemblies incorporating stiles and rails as framing members to define the outside perimeter of the door or window are generally known. In standard constructions, the window or door assembly would include a pair of vertical, generally parallel, spaced apart stiles, one stile on the hinge side and one on the latch side of the assembly. The assembly would also include a pair of generally horizontal rails which are connected to, and extend between, the pair of stiles proximate their ends to define a generally rectangular frame. At least one panel is then disposed within the rectangular frame to fill the opening. The panel may be wood or glass or a combination of the two.

It is also recognized that multiple panels, whether glass, wood or other material, may be utilized. When multiple panels are utilized, a framework of supporting members of a desired pattern extend from the stiles and/or rails to support the multiple panels.

Presently available window or door assemblies incorporating a stile and rail frame are usually manufactured from wood, polymer, or metal. It is, further, generally recognized that polymer or metal assemblies are aesthetically less desirable, particularly in home construction wherein extensive amounts of wood trim and wood framed windows are utilized.

When wood is selected as the framing material for stiles or rails, problems other than aesthetics have been identified. Wood is known to change dimension with the taking on and giving up of moisture and this results in warpage of the member. The warpage can be permanent and prevent proper sealing against air infiltration around the perimeter of the door or window, when the window is closed. Further, warpage can prevent a proper fit for latching, locking or otherwise securing the door or window. Wood framing members of desired dimensions are also known to have less strength than other materials. Wood frame members may deflect to the point of failure when large loads are applied.

Accordingly, the need exists for a composite framing member which can incorporate both the aesthetics of a wood exterior surface and the reduced warpage and added strength of a non-wood member. The present invention addresses these needs as well as other problems associated with existing framing members suitable for use as stiles or rails in window or door assemblies. The present invention also offers further advantages over the prior art and solves problems associated therewith.

SUMMARY OF THE INVENTION

The present invention is a composite framing member especially suitable for use as a stile in a window or door frame assembly. The composite member also provides an internal passage over the length of the composite member for placement of lock hardware or lock assemblies, in a preferred embodiment.

The preferred stile is comprised of a fiberglass-reinforced, pultruded core material, containing lineal roving glass fiber, surrounded by randomly oriented glass fiber matting, in a matrix of polyester resin. The core member, a hollow tubular member, is completely overlayed with wood or other appropriate material. This combination gives the stile excellent physical characteristics, such as a high modulus of elasticity and dimensional stability. It has been found that a stile incorporating the features of the present invention, detailed below, exhibits at least a three-fold reduction in warpage under accelerated test conditions. Test conditions of 90 percent relative humidity for a period of eight days continuous exposure were utilized.

The wood overlay can include two pieces of wood specifically sized as edge inserts. These parts are machined to match the profile of channels formed in two surfaces of the fiberglass-reinforced pultruded plastic core member, of a preferred embodiment. Three advantages have been realized with this construction. First, the edge inserts aid in the processing of the composite stile by serving as locators to ensure proper placement of overlays. Next, the channels place materials where needed for performance by providing the most possible fiberglass reinforced plastic material for a vapor barrier. Finally, the preferred cross section of the core material provides shear strength which is needed at glue lines.

Two overlays made of wood or other appropriate material are placed over the two longitudinal surfaces of the core member, or hollow tubular member. It has been found that, in a preferred embodiment, the edge inserts should be of the exact width of the core member and have a surface which is located in the same plane as the longitudinal surfaces of the core member for placement of the overlay. In a preferred method of manufacture, this is accomplished by oversizing the inserts and machining them after they have been adhered to the core, by referencing off the longitudinal faces of the hollow tubular member or core member. This provides additional strength at glue lines.

The composite framing member of the present invention includes a hollow tubular member, of a given length, having an exterior surface perimeter defined by a first and a second lateral surface and a first and a second longitudinal surface. The first lateral surface is opposite the second lateral surface, while the first longitudinal surface is opposite the second longitudinal surface. In a preferred embodiment, the hollow tubular member has a generally rectangular cross section.

A first edge insert, having a first surface engaging the first lateral surface over the given length of the hollow tubular member, is included. The first edge insert further has a second surface, at least a portion of which is coplanar with the first longitudinal surface, and a third surface, at least a portion of which is coplanar with the second longitudinal surface.

A second edge insert is provided which has a first surface engaging to the second lateral surface over the given length of the hollow tubular member. The second edge insert further includes a second surface, at least a portion of which is coplanar with the first longitudinal surface, and a third surface, at least a portion of which is coplanar with the second longitudinal surface.

A first overlay is affixed to and overlying the first longitudinal surface, at least a portion of the second surface of the first edge insert which is coplanar with the first longitudinal surface, and at least a portion of the second surface of the second edge insert which is coplanar with the first longitudinal surface. Likewise, a second overlay is affixed to and overlying the second longitudinal surface, at least a portion of the third surface of the first edge insert which is coplanar with the second longitudinal surface, and at least a portion of the third surface of the second edge insert which is coplanar with the second longitudinal surface.

The hollow tubular member, which defines a preferably rectangular channel, can also include four flanges extending the length of the hollow tubular member to provide additional gluing surface and aid in placement of the edge inserts. A first flange protrudes from the first lateral surface and has a surface coplanar with the first longitudinal surface. A second flange protrudes from the first lateral surface and has a surface coplanar with the second longitudinal surface. The first flange, the first lateral surface and the second flange form a channel for receiving the first edge insert therein.

Likewise, a third flange protrudes from the second lateral surface and has a surface coplanar with the first longitudinal surface. A fourth flange protrudes from the second lateral surface and has a surface coplanar with the second longitudinal surface. The third flange, the second lateral surface and the fourth flange form a channel for receiving the second edge insert therein.

The composite framing member of the present invention is preferably utilized in a window or door assembly which incorporates a pair of vertical, generally parallel spaced apart stiles including a hinge side stile and a latch side stile. The composite framing member of the present invention is particularly useful as the latch side stile where strength and reduced warpage are especially needed. A door or window assembly utilizing the stile of the present invention generally includes a pair of horizontal members or rails connected to, and extending between, the pair of stiles proximate their ends to define a rectangular frame wherein at least one panel is disposed to fill the opening.

The composite door stile of the present invention may also be used in a door stile and lock assembly. In this embodiment, the composite framing member is utilized as the stile and includes a lock mechanism. The lock mechanism can include a first rod-like member which is slidably disposed within the hollow tubular member and extends from a point intermediate the composite stile toward one end thereof. A second rod-like member can be utilized which is slidably disposed within the hollow tubular member and extends from a point intermediate the composite stile toward the other end thereof. Means for moving the first and second rod-like members from first unlocked positions to second locked positions are operatively connected thereto. With this construction, the locking members are completely hidden from view to provide adequate added security by preventing undesired access.

These and various other advantages and features of novelty which characterize the present invention are pointed out with particularity in the claims annexed hereto and forming a part hereof. However, for a better understanding of the invention, its advantages, and the object obtained by its use, reference should be made to the drawings which form a further part hereof, and to the accompanying descriptive matter in which there are illustrated and described preferred embodiments of the present invention.

BRIEF DESCRIPTION OF THE DRAWINGS

In the drawings, in which like reference numerals indicate corresponding parts or elements of preferred embodiments of the present invention throughout the several views.

DETAILED DESCRIPTIONS OF THE INVENTION

Detailed embodiments of the present invention are disclosed herein. However, it is to be understood that the disclosed embodiments are merely exemplary of the present invention which may be embodied in various systems. Therefore, specific details disclosed herein are not to be interpreted as limiting, but rather as a basis for the claims and as a representative basis for teaching one of skill in the art to practice the invention.

Figure 1:
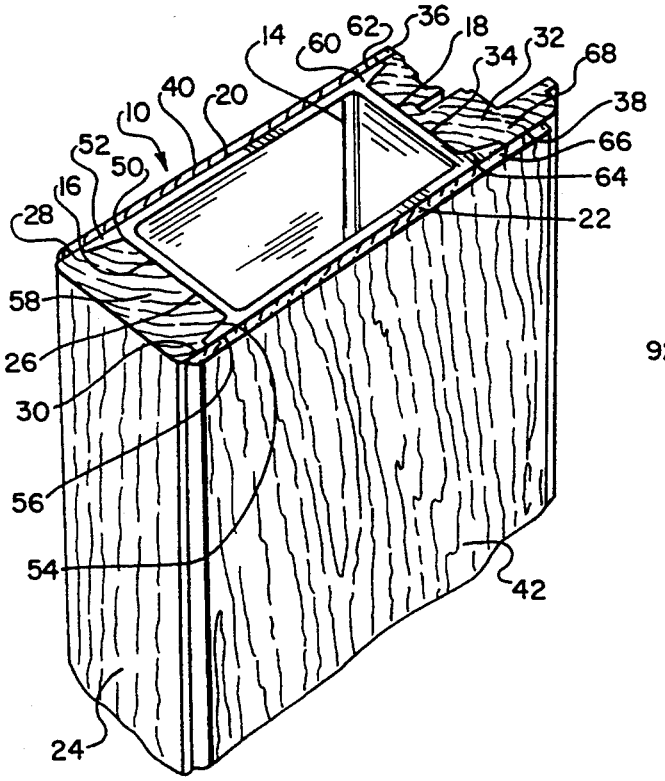
FIG. 1 is a perspective view of a composite framing member embodying the present invention.
Figure 3:
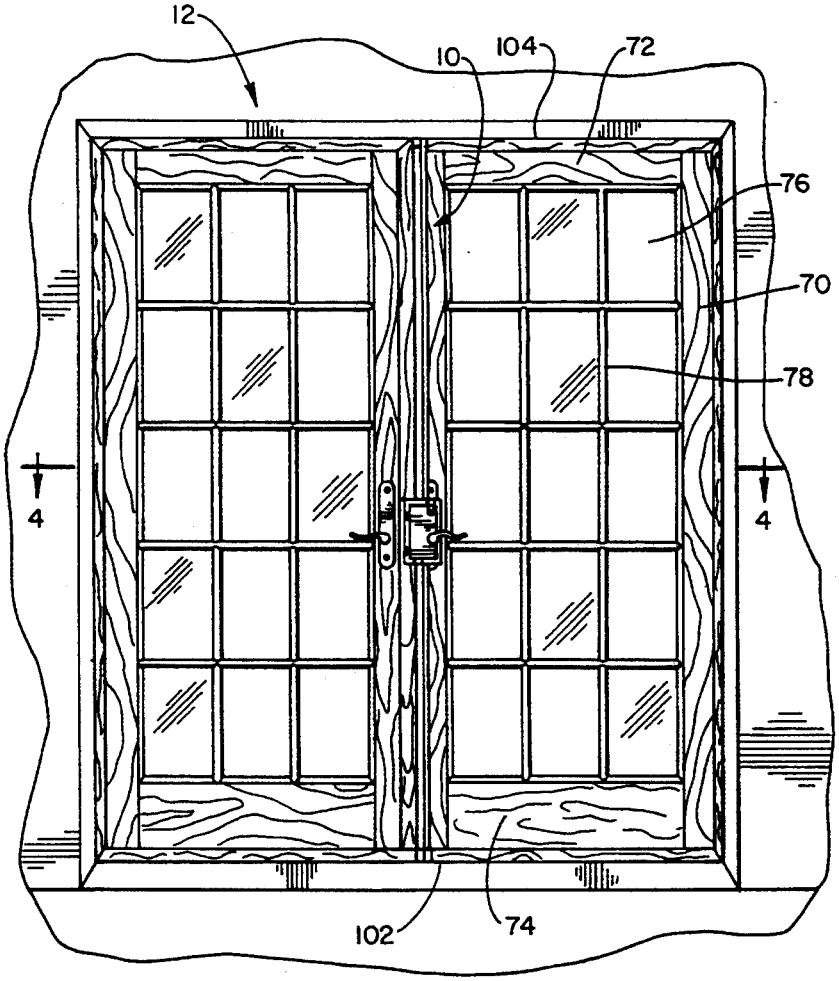
FIG. 3 is an orthographic view of a door assembly incorporating the composite frame member of the present invention.

Referring now to FIG. 1, a perspective view of a composite framing 10 embodying the features of the present invention is illustrated. As previously stated, the composite framing member 10 is particularly useful as a stile in a door or window frame assembly. In FIG. 3, the composite framing 10 is depicted incorporated as a stile in a French door unit 12.

The composite framing member 10 depicted in FIG. 1 includes a hollow member 14, of a given length, which has an exterior surface perimeter defined by a first lateral surface 16 and a second lateral surface 18. The first lateral surface 16 is opposite the second lateral surface 18. The hollow member 14 perimeter is further defined by a first longitudinal surface 20 and a second longitudinal surface 22. The first longitudinal surface 20 is opposite the second longitudinal surface 22.

The composite framing member 10 further includes a first edge insert 24. The first edge insert 24 has a first surface 26 which abuts the first lateral surface 16 over the length of the member 14. The first edge insert 24 also has a second surface 28, at least a portion of which is coplanar with the first longitudinal surface 20. A third surface 30 is also included on the first edge insert 24, at least a portion of which is coplanar with the second longitudinal surface 22.

Likewise, a second edge insert 32 having a first surface 34 abuts the second lateral surface 18 over the length of the member 14. The second edge insert 32 also has a second surface 36, at least a portion of which is coplanar with the first longitudinal surface 20. The second edge insert 32 also includes a third surface 38, at least a portion of which is coplanar with the second longitudinal surface 22.

A first overlay 40 is affixed to, and overlying, the first longitudinal surface 20. The first overlay 40 further overlies at least a portion of the second surface 28 of the first edge insert 24 which is coplanar with the first longitudinal surface 20, and at least a portion of the second surface 36 of the second edge insert 32 which is coplanar with the first longitudinal surface 20. With this construction, it has been found that added strength is achieved along the glue line by adhering the overlay 40 to the edge insert second surfaces 28, 36 in addition to the first longitudinal surface 20.

A second overlay 42 is affixed to, and overlying, the second longitudinal surface 22. The second overlay 42, as with the first overlay 40, is also affixed to and overlying at least a portion of the third surface 30 of the first edge insert 24 which is coplanar with the second longitudinal surface 22. The second overlay 42 also overlies at least a portion of the third surface 38 of the second edge insert 32 which is coplanar with the second longitudinal surface 22.

In a preferred embodiment, the hollow member 14 incorporates multiple flanges protruding from the lateral surfaces 16, 18. These flanges aid in locating the first edge insert 24 and second edge insert 32 during assembly to assure proper placement. The flanges further provide structural stability to the hollow member 14 and prevent warpage at critical locations.

In the above generally described preferred embodiment, a first flange 50 protrudes from the first lateral surface 16 over the length of the hollow member 14. The first flange 50 has a surface 52 which is coplanar with the first longitudinal surface 20.

A second flange 54 protrudes from the first lateral surface 16 over the length of the hollow member 14. The second flange 54 has a surface 56 which is coplanar with the second longitudinal surface 22.

Together, the first flange 50, the first lateral surface 16, and the second flange 54 form a first channel 58 for receiving the first edge insert 24 therein.

Likewise, in the above described preferred embodiment, a third flange 60 protrudes from the second lateral surface 18 over the length of the hollow member 14. The third flange 60 also has a surface 62 coplanar with the first longitudinal surface 20. A fourth flange 64 protrudes from the second lateral surface 18 over the length of the hollow member 14. The fourth flange 64 has a surface 66 which is coplanar with the second longitudinal surface 22. The third flange 60, the second lateral surface 18, and the fourth flange 66 combine to form a second channel 68 for receiving the second edge insert 32 therein.

In a preferred embodiment the composite framing member 10 incorporates a hollow member 14 which is manufactured from a fiberglass reinforced pultruded plastic. The preferred manufacturing technique is a pultrusion process wherein a hollow member 14 incorporates a fiberglass reinforced, pultruded core material containing lineal roving glass fibers, surrounded by randomly oriented glass fiber matting, in a matrix of polyester resin. The material of construction for the first 24 and second 32 edge inserts along with the first overlay 40 and second overlay 42 is wood.

As depicted in FIG. 1, the hollow member 14 preferably has a generally rectangular cross-section wherein the first and second opposite lateral surfaces 16,18 are generally parallel. The first and second opposite longitudinal surfaces 20, 22 are also generally parallel.

As is evident from the preferred embodiment pictured in FIG. 1, when incorporating first flange 50, second flange 54, third flange 60, and fourth flange 64 into the design of the composite member 10, it is necessary to shape the first surface 26 of the first edge insert 16 so as to conform to the shape of the first channel 58 along the length of the hollow member 14. Likewise, it is necessary to shape the first surface 34 of the second edge insert 32 so as to conform to the shape of the second channel 68 over the length of the hollow member 14.

The composite framing member 10 can be incorporated in a door or window assembly. A door assembly 12 is generally depicted in FIG. 3. With this general construction, a pair of generally parallel spaced apart stiles 10, 70 are included. These include a hinge side stile 70 and a latch or lock side stile 10 which is the composite framing member depicted in FIG. 1.

The door or window assembly further includes a pair of generally horizontal rails 72, 74 which are affixed to, and extend between, the pair of stiles 10, 70. At least one panel 76 is disposed within the opening in the rectangular frame created by the stiles and rails. It is recognized, however, that multiple panels may be utilized in conjunction with a multitude of web-like members 78 to form a geometrical pattern within the opening while filling its entirety. These panels may include opaque materials such as wood, transparent materials such as glass, and/or translucent material such as frosted glass.

Figure 4:
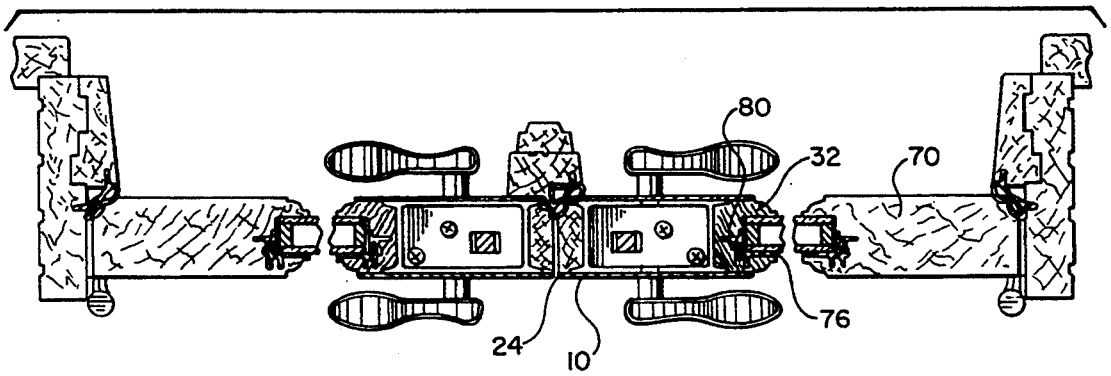
FIG. 4 is a cross-sectional view of the door assembly of FIG. 3 taken generally along Line 4—4 thereof.

Now referring to FIG. 4, a partial cross-sectional view along Line 4—4 of FIG. 3 is illustrated. A cross-section of the composite framing member 10 in this view illustrates how the first edge insert 24 provides the surface wherein the two French doors meet when closed. The second edge insert 32 includes multiple channels and grooves for placement of a panel 76 therein. The channels and grooves provide both a location for insertion of the panels 76 and sealing elements 80 which prevent air infiltration.

Figure 2:
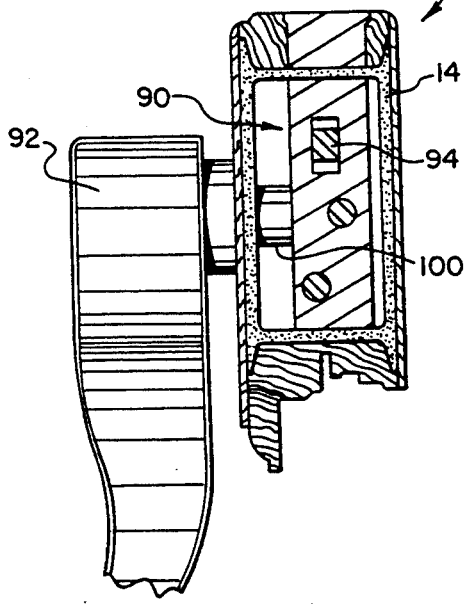
FIG. 2 is a cross-sectional view of the composite framing member of the present invention taken generally along Line 2—2 of FIG. 6 which depicts the locking assembly in a preferred embodiment.
Figure 5:
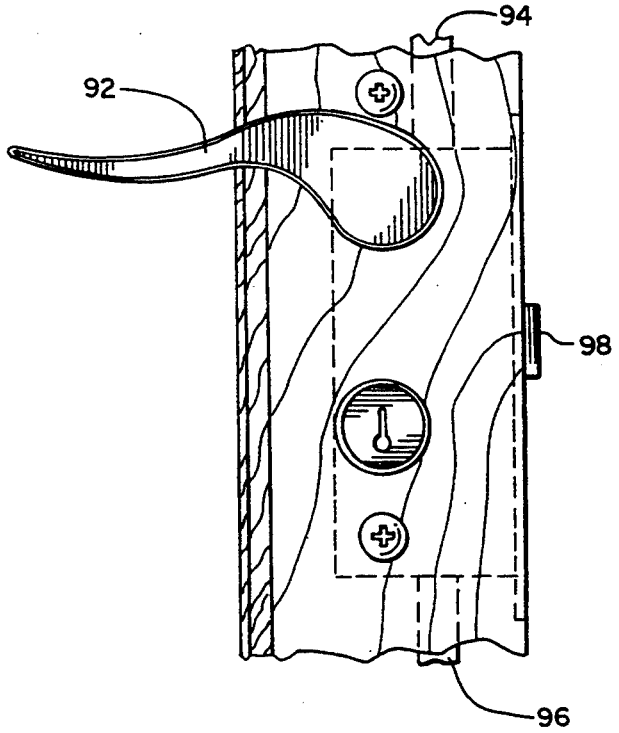
FIG. 5 is a fragmentary front elevational view of a composite stile depicting a portion of the lock assembly.
Figure 6:
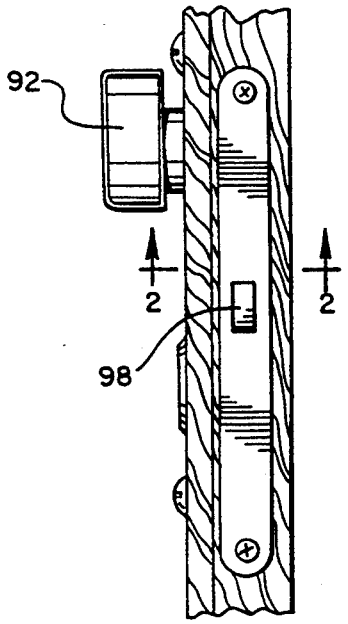
FIG. 6 is a fragmentary right side elevational view of the stile member and lock assembly of FIG. 5.

Referring now to FIG. 2, a cross-sectional view of the composite member 10 utilized as a door stile is illustrated. With this embodiment, a door stile 10 and lock assembly, which utilizes the hollow passage 90 in the hollow member 14 is depicted. FIG. 5 provides further detail of this preferred embodiment in a fragmentary front elevational view. The cross-section of FIG. 2 is taken from the fragmentary right side elevational view depicted in FIG. 6, along Line 2—2.

The lock assembly comprises a lock mechanism which includes a first rod-like member 94 which is slidably disposed within the passage 90 of the hollow member 14 and extends from a point intermediate the ends of the composite stile 10 to one end thereof. A second rod-like member 96 is slidably disposed within the passage 90 of the hollow member 14 and extends from a point intermediate the ends of the composite stile 10 to the other end thereof.

Means for moving the first and second rod-like members 94, 96 from a first, unlocked position to a second, locked position are operatively connected to the rods 94, 96. The means can include a rotatable handle 92 and shaft 100 which can be connected in a standard fashion, such as by employment of a gear or lever arm to the rods 94, 96. In the second, locked position the first and second rod-like members 94, 96 extend beyond the respective ends of the composite stile 10. In this locked position, the ends of the rod-like members are releasably received within the sill 102 or frame 104, depicted in FIG. 3, to secure the door in a closed position. In the first, unlocked position, the first and second rod-like members 94, 96 are substantially retracted within the passage 90 of the hollow member 14.

A deadbolt lock assembly 98 can also be incorporated in preferred embodiments to give added security. With the composite stile 10 construction of the present invention, the lock assembly is completely hidden from view or access. This gives added security relative to existing lock assemblies. Further, the hidden lock assembly is aesthetically pleasing.

A preferred method of manufacture of a composite door or window stile includes the steps of first pultruding a generally rectangular hollow member as specified above. A first edge insert is provided which has a surface conforming to the surface of the first channel. In contrast to the finished product described above, the second surface of the first edge insert has at least a portion which protrudes beyond the first longitudinal surface and the third surface has at least a portion which protrudes beyond the second longitudinal surface.

The first edge insert is then affixed within the first channel. A preferred method of affixing the edge insert is by adhesive means, such as glue.

A second edge insert is provided which is similar to the first edge insert. The first surface conforms to the surface of the second channel, while the second surface includes a portion of which protrudes beyond the first longitudinal surface and the third surface includes a portion of which protrudes beyond the second longitudinal surface.

Likewise, the second edge insert is affixed within the second channel. The preferred method of affixing the second edge insert is by adhesive means, such as glue.

The second surfaces of the first and second edge inserts are then machined while referencing off of the first longitudinal surface. The surfaces are machined until such surfaces are coplanar with the first longitudinal surface. Likewise, the third surfaces of the first and second edge insert are machined to a point wherein the third surfaces are coplanar with the second longitudinal surface.

The first and second overlays are then affixed to their respective longitudinal surfaces subsequent to machining. These steps assure coplanar surfaces between the longitudinal surfaces and the second and third surfaces of the edge inserts which provides superior gluing surfaces for the laminates.

New characteristics and advantages of the invention covered by this document have been set forth in the foregoing description. It will be understood, however, that this disclosure is, in many respects, only illustrative. Changes may be made in details, particularly in matters of shape, size, and arrangement of parts, without exceeding the scope of the invention. The scope of the invention is, of course, defined in the language in which the appended claims are expressed.

What is claimed is:

1. A composite framing member, comprising:

(a) a hollow member, of a given length, having an exterior surface perimeter defined by a first and a second lateral surface, said first lateral surface opposite said second lateral surface, and a first and a second longitudinal surface, said first longitudinal surface opposite said second longitudinal surface;

(b) a first edge insert having a first surface engaging said first lateral surface over said given length of said hollow member, said first edge insert further having a second surface, at least a portion of which is coplanar with said first longitudinal surface, and a third surface, at least a portion of which is coplanar with said second longitudinal surface;

(c) a second edge insert having a first surface engaging said second lateral surface over said given length of said hollow member, said second edge insert further having a second surface, at least a portion of which is coplanar with said first longitudinal surface, and a third surface, at least a portion of which is coplanar with said second longitudinal surface;

(d) a first overlay affixed to, and overlying, said first longitudinal surface, at least a portion of said second surface of said first edge insert which is coplanar with said first longitudinal surface and at least a portion of said second surface of said second edge insert which is coplanar with said first longitudinal surface; and (e) a second overlay affixed to, and overlying, said second longitudinal surface, at least a portion of said third surface of said first edge insert which is coplanar with said second longitudinal surface and at least of portion of said third surface of said-second edge insert which is coplanar with said second longitudinal surface.

2. The composite framing member of claim 1 wherein said hollow member further comprises:

(a) a first flange, protruding from said first lateral surface over said given length, having a surface coplanar with said first longitudinal surface, and a second flange, protruding from said first lateral surface over said given length, having a surface coplanar with said second longitudinal surface, wherein said first flange, said first lateral surface and said second flange form a first channel for receiving said first edge insert therein; and (b) a third flange, protruding from said second lateral surface over said given length, having a surface coplanar with said first longitudinal surface, and a fourth flange, protruding from said second lateral surface over said given length, having a surface coplanar with said second longitudinal surface, wherein said third flange, said second lateral surface and said fourth flange form a second channel for receiving said second edge insert therein.

3. The composite framing member of claim 1 wherein said hollow member is manufactured from fiberglass reinforced plastic.

4. The composite framing member of claim 3 wherein said hollow member is pultruded.

5. The composite framing member of claim 1 wherein said hollow tubular member comprises a fiberglass reinforced, pultruded core material containing lineal roving glass fibers and glass fiber matting in a matrix of polyester resin.

6. The composite framing member of claim 3 wherein said first and said second edge inserts and said first and said second overlays are wood.

7. A composite framing member, comprising:

(a) a generally rectangular hollow member having an exterior surface perimeter defined by a first and a second opposite lateral surface and a first and a second opposite longitudinal surface, said generally rectangular hollow member further having, (i) a first flange protruding from said first lateral surface, said first flange having a surface coplanar with said first longitudinal surface, a second flange protruding from said first lateral surface, said second flange having a surface coplanar with said second longitudinal surface, and wherein said first flange, said first lateral surface and said second flange form a first channel; and (ii) a third flange protruding from said second lateral surface, said third flange having a surface coplanar with said first longitudinal surface, a fourth flange protruding from said second lateral surface, said fourth flange having a surface coplanar with said second longitudinal surface, and wherein said third flange, said second lateral surface and said fourth flange form a second channel;

(b) a first edge insert having a first surface affixed within said first channel, said first edge insert further having a second surface, at least a portion of which is coplanar with said first longitudinal surface, and a third surface, at least a portion of which is coplanar with said second longitudinal surface;

(c) a second edge insert having a first surface affixed within said second channel, said second edge insert further having a second surface, at least a portion of which is coplanar with said first longitudinal surface, and a third surface, at least a portion of which is coplanar with said second longitudinal surface;

(d) a first overlay affixed to, and overlying, said first longitudinal surface, at least a portion of said second surface of said first edge insert which is coplanar with said first longitudinal surface, and at least a portion of said second surface of said second edge insert which is coplanar with said first longitudinal surface; and (e) a second overlay affixed to, and overlying, said second longitudinal surface, at least a portion of said third surface of said first edge insert which is coplanar with said second longitudinal surface, and at least a portion of said third surface of said second edge insert which is coplanar with said second longitudinal surface.

8. The composite framing member of claim 7 wherein said hollow member is pultruded from fiberglass reinforced plastic.

9. The composite framing member of claim 8 wherein said first and said second edge inserts and said first and said second overlays are wood.

10. The composite framing member of claim 8 wherein said first and said second edge inserts are adhesively affixed within said first and said second channels, respectively.

11. The composite framing member of claim 10 wherein said first and said second overlays are adhesively affixed to said first and said second longitudinal surfaces, respectively.

12. In a door or window assembly having a pair of vertical, generally parallel spaced apart stiles, including a hinge side stile and a latch side stile, and a pair of generally horizontal rails affixed to and extending between said pair of stiles proximate their ends to define a generally rectangular frame wherein at least one panel is disposed within said rectangular frame, the improvement comprising a latch side stile including:

(a) a hollow member, of a given length, having an exterior surface perimeter defined by a first and a second lateral surface, said first lateral surface opposite said second lateral surface, and a first and a second longitudinal surface, said first longitudinal surface opposite said second longitudinal surface;

(b) a first edge insert having a first surface affixed to said first lateral surface over said given length of said hollow member, said first edge insert further having a second surface, at least a portion of which is coplanar with said first longitudinal surface, and a third surface, at least a portion of which is coplanar with said second longitudinal surface;

(c) a second edge insert having a first surface affixed to said second lateral surface over said given length of said hollow member, said second edge insert further having a second surface, at least a portion of which is coplanar with said first longitudinal surface, and a third surface, at least a portion of which is coplanar with said second longitudinal surface;

(d) a first overlay affixed to, and overlying, said first longitudinal surface, at least a portion of said second surface of said first edge insert which is coplanar with said first longitudinal surface and at least a portion of said second surface of said second edge insert which is coplanar with said first longitudinal surface; and (e) a second overlay affixed to, an overlying, said second longitudinal surface, at least a portion of said third surface of said first edge insert which is coplanar with said second longitudinal surface and at least of portion of said third surface of said second edge insert which is coplanar with said second longitudinal surface.

13. The window or door assembly of claim 12 wherein said hollow member of said latch side stile further comprises:

(a) a first flange protruding from said first lateral surface over said given length having a surface coplanar with said first longitudinal surface and a second flange protruding from said first lateral surface over said given length having a surface coplanar with said second longitudinal surface, wherein said first flange, said first lateral surface and said second flange form a first channel for receiving said first edge insert therein; and (b) a third flange protruding from said second lateral surface over said given length having a surface, coplanar with said first longitudinal surface and a fourth flange protruding from said second lateral surface over said given length having a surface coplanar with said second longitudinal surface, wherein said third flange, said second lateral surface and said fourth flange form a second channel for receiving said second edge insert therein.

14. The door or window assembly of claim 12 wherein said hollow member is manufactured from fiberglass reinforced plastic.

15. The door or window assembly of claim 14 wherein said hollow member is pultruded.

16. The door or window assembly of claim 12 wherein said hollow member comprises a fiberglass reinforced, pultruded core material containing lineal roving glass fibers, surrounded by random glass fiber matting, in a matrix of polyester resin.

17. The door or window assembly of claim 14 wherein said first and said second edge inserts, said first and said second overlays, said hinge side stile and said pair of rails are wood.

18. A door stile and lock assembly, comprising:

(a) a composite stile including, (i) a generally rectangular hollow member having an exterior surface perimeter defined by a first and a second opposite lateral surface and a first and a second opposite longitudinal surface, said generally rectangular hollow member further having a first flange protruding from said first lateral surface, said first flange having a surface coplanar with said first longitudinal surface, a second flange protruding from said first lateral surface, said second flange having a surface coplanar with said second longitudinal surface, wherein said first flange, said first lateral surface and said second flange form a first channel, a third flange protruding from said second lateral surface, said third flange having a surface coplanar with said first longitudinal surface, a fourth flange protruding from said second lateral surface, said fourth flange having a surface coplanar with said second longitudinal surface, wherein said third flange, said second lateral surface and said fourth flange form a second channel;

(ii) a first edge insert having a first surface affixed within said first channel, said first edge insert further having a second surface, at least a portion of which is coplanar with said first longitudinal surface, and a third surface, at least a portion of which is coplanar with said second longitudinal surface;

(iii) a second edge insert having a first surface affixed within said second channel, said second edge insert further having a second surface, at least a portion of which is coplanar with said first longitudinal surface, and a third surface, at least a portion of which is coplanar with said second longitudinal surface;

(iv) a first overlay affixed to and overlying said first longitudinal surface, at least a portion of said second surface of said first edge insert which is coplanar with said first longitudinal surface, and at least a portion of said second surface of said second edge insert which is coplanar with said first longitudinal surface; and (v) a second overlay affixed to and overlying said second longitudinal surface, at least a portion of said third surface of said first edge insert which is coplanar with said second longitudinal surface, and at least a portion of said third surface of said second edge insert which is coplanar with said second longitudinal surface; and (b) a lock mechanism including, (i) a first rod-like member slidably disposed within said generally rectangular hollow member extending from a point intermediate ends of said composite stile to one end thereof;

(ii) a second rod-like member slidably disposed within said generally rectangular hollow member extending from said point intermediate ends of said composite stile to the other end thereof; and (iii) means for moving said first and said second rod-like members from a first, unlocked position to a second, locked position, wherein in said second, locked position, both said first and said second rod-like members extend beyond a respective end of said composite stile.

19. The door stile and lock assembly of claim 18 wherein said hollow member is pultruded from fiberglass reinforced plastic.

20. The door stile and lock assembly of claim 19 wherein said first and said second edge inserts and said first and said second overlays are wood.

21. The door stile and lock assembly of claim 20 wherein said first and said second edge inserts are adhesively affixed within said first and said second channels, respectively.

22. The door stile and lock assembly of claim 21 wherein said first and said second overlays are adhesively affixed to said first and said second longitudinal surfaces, respectively.

* * * * *